US006695289B1

(12) United States Patent
Mickael

(10) Patent No.: US 6,695,289 B1
(45) Date of Patent: Feb. 24, 2004

(54) MOTOR DRIVEN SCISSOR JACK WITH LIMIT SWITCHES

(76) Inventor: Emil Mickael, 620 McCully St., Apt. 508, Honolulu, HI (US) 96826

( * ) Notice: Subject to any disclaimer, the term of this patent is extended or adjusted under 35 U.S.C. 154(b) by 0 days.

(21) Appl. No.: 10/356,856

(22) Filed: Feb. 3, 2003

(51) Int. Cl.[7] ..... B66F 3/22

(52) U.S. Cl. ..... 254/122; 254/126; 187/211

(58) Field of Search ..... 254/122, 124, 254/126, 7 R, 7 B, 9 R, 9 B; 182/141, 63, 69; 187/211, 18, 8.5, 8.71, 8.72

(56) References Cited

U.S. PATENT DOCUMENTS 2,218,733 A 10/1940 Watts
3,451,655 A 6/1969 Scott
3,997,143 A 12/1976 Rose
4,653,727 A * 3/1987 Chang et al. ..... 254/1
4,749,169 A 6/1988 Pickles
4,872,230 A * 10/1989 Levine ..... 7/100
4,941,797 A * 7/1990 Smillie, III ..... 414/462
4,943,034 A * 7/1990 Wagnon ..... 254/122
5,085,407 A 2/1992 Lonon
5,366,203 A * 11/1994 Huffman ..... 254/362
5,707,043 A 1/1998 Yoshida
6,029,950 A 2/2000 Yeh
6,237,953 B1 * 5/2001 Farmer ..... 280/763.1
6,299,138 B1 10/2001 Huang et al.

* cited by examiner

*Primary Examiner*—Joseph J. Hail, III
*Assistant Examiner*—Daniel Shanley
(74) *Attorney, Agent, or Firm*—Michael I Kroll

(57) ABSTRACT

A motorized scissor jack is provided including upper and lower limit switches. The motor is connected with a drive assembly that extends and retracts the jack through a displacement screw. The motor has two speeds. The jack is connectable to a vehicular or standard alternating current power source. The upper and lower limit switches limit the extension and retraction of the jack to defined peak and bottom points. The jack is configured for operation in inclement weather.

20 Claims, 8 Drawing Sheets

MOTOR DRIVEN SCISSOR JACK WITH LIMIT SWITCHES

BACKGROUND OF THE INVENTION

1. Field of the Invention

The present invention relates generally to scissor type jacks and, more specifically, to motor driven scissor jacks for vehicular applications.

2. Description of the Prior Art

There are other scissor jack devices designed for lifting and lowering an automobile. Typical of these is U.S. Pat. No. 2,218,733 issued to Watts on Oct. 22, 1940.

Another patent was issued to Scott on Jun. 24, 1969 as U.S. Pat. No. 3,451,655. Yet another U.S. Pat. No. 3,997,143 was issued to Rose on Dec. 14, 1976 and still yet another was issued on Mar. 31, 1987 to Chang et al. as U.S. Pat. No. 4,653,727.

Another patent was issued to Pickles on Jun. 7, 1988 as U.S. Pat. No. 4,749,169. Yet another U.S. Pat. No. 4,872,230 was issued to Levine on Oct. 10, 1989. Another was issued to Wagnon on Jul. 24, 1990 as U.S. Pat. No. 4,943,034 and still yet another was issued on Feb. 4, 1992 to Lonon as U.S. Pat. No. 5,085,407.

Another patent was issued to Yoshida on Jan. 13, 1998 as U.S. Pat. No. 5,707,043. Yet another U.S. Pat. No. 6,029,950 was issued to Yeh on Feb. 29, 2000. Another was issued to Farmer on May 29, 2001 as U.S. Pat. No. 6,237,953 and still yet another was issued on Oct. 9, 2001 to Huang et al. as U.S. Pat. No. 6,299,138.

U.S. Pat. No. 2,218,733

Inventor: Roy T. Watts

Issued: Oct. 22, 1940

This invention relates to a jacking arrangement for automobiles whereby a lifting jack is secured on the lower part of the chassis of a vehicle. The jack has a scissors configuration with a motor positioned between scissor arm elements. The extension of the jack is limited by a switch handle which is configured for cutting off the current flow as the switch is closed by the action of a jack arm approximately reaching a maximum extension position. Simultaneously, a switch handle is depressed changing the polarity of the current flow through the motor thereby positioning the motor for the retraction of the jack. At the instant prior to the jack reaching a maximum retracted position, polarity switch handle is depressed again reversing the polarity of the motor.

U.S. Pat. No. 3,451,655

Inventor: Lawrence P. Scott

Issued: Jun. 24, 1969

The present invention is a vehicular scale jack positioned on a wheeled trailer with an electric motor drive arrangement for the operation of lifting and descending of the vehicle to its position for operation. The jack has gear configured for a high speed and a low speed of operation. Switches and are used to control the direction of movement of the jack. Releasing the switches during operation stops the jack in the present position.

U.S. Pat. No. 3,997,143

Inventor: Frank P. Rose

Issued: Dec. 14, 1976

In-place vehicle jack assemblies of the pivoted lever type configured for being permanently mounted at the front and rear of the vehicle frame structure are described. Each of the jack assemblies comprise a unitary device which is independently operable by an electrical motor, and independently selectively controlled at the jack or remotely from the control compartment of the vehicle, control circuits for the jacking assemblies are interlocked with the ignition system of the engine, so that the jacks are operable only when the ignition switch is in an off position. Solenoid actuated relays mounted to the motor housing control the direction of rotation of the motor. The threads of the screw are disengaged from the nut in the fully retracted position. The screw then reengages the nut for extension.

U.S. Pat. No. 4,653,727

Inventor: Shoei D. Chang et al.

Issued: Mar. 31, 1987

The invention relates to motor driven scissors jacks for automobiles driven by an electric power source from the cigarette lighting socket of any automobile. The scissors jack includes a DC motor driven through a deceleration gear box for rotating a screw rod clockwise or counter-clockwise for the raising of the frames of scissors jacks. The jack provides the ability for the automatic raising of vehicles as well as the higher raising and lower collapsing functions and a more powerful raising capability. The jack also includes one ultimate switch for peak and low bottom points. The power supply is automatically cut off when a lower raising rod pushes snapping rod of an ultimate switch.

U.S. Pat. No. 4,749,169

Inventor: Joseph Pickles

Issued: Jun. 7, 1988

A motorized user applied actuator for automobile and like jacks having rotatable operating members for raising and lowering the jack platform. The jack comprises a casing having a drive member detachably cooperable with the jack operating member, an electric motor, and a lightweight step-down transmission connecting the motor with the drive member. The transmission comprises a plurality of staged planetary assemblages which effect a great reduction in speed and advantageous conversion of power. In several illustrated embodiments of the invention one or more handles are attached to the motor casing to provide a convenient hand grip for the manual extension and retraction of the jack. In one embodiment the drive member of the actuator has back-to-back elements alternately engageable with the jack operating member to effect a reversal of the jack movement without reversing the motor. A handle includes start and stop buttons conveniently positioned for application by a user.

U.S. Pat. No. 4,872,230

Inventor: Anthony Levine

Issued: Oct. 10, 1989

A portable automatic automobile scissor jack is described including an electrically powered automobile tire nut remover. The jack is powered through a cigarette lighter type plug by the automobile battery, and has an outlet for powering of a tire nut remover or other equipment. In another embodiment, the nut remover, powered by the auto battery, drives the jack.

U.S. Pat. No. 4,943,034

Inventor: Gerald E. Wagnon

Issued: Jul. 24, 1990

An adapter for a jack is described having a threadable jack shaft and a support platform that rises or lowers when the threadable jack shaft turns. The adapter has a housing containing a drive motor that is coupled to a drive shaft. The adapter has an engagement bracket for releasing and engaging the adapter to the jack. Spring loaded bolts bias the engagement bracket against the face of the housing. To stop the jack a switch can be positioned in a neutral position. In addition, at a lower limit the engagement bracket is disconnected from the support-alignment bar to disengage the drive shaft from the threaded jack shaft. A jack and adapter in combination and a method for operating a jack having support aligning bars wherethrough a threadable jack shaft rotatably passes to raise or lower a support platform of the jack upon rotation.

U.S. Pat. No. 5,085,407

Inventor: Edward M. Lonon

Issued: Feb. 4, 1992

A motorized jack assemblage for vehicles in the form of a kit is described containing a motor and reduction gear linkage adapted to be energized from the cigarette lighter or other source of electrical power in the vehicle. The gear linkage is adapted to drive mechanical coupling means, which keys into and operates a screw type lift jack, which in one case is part of the standard equipment for the vehicle, and in another case is a jack with a specialized base which is part of the kit. A toggle switch is used to control the movement of the jack and includes a right, left, and neutral position.

U.S. Pat. No. 5,707,043

Inventor: Kazuhiko Yoshida

Issued: Jan. 13, 1998

A driving joint for jacks is described including a joint block secured to an output shaft of an electric driving unit. A U-shaped connection plate connected at its opposite ends to the joint block and provides an elongated connection hole in its front wall. The connection plate can be engaged within the U-shaped driven joint, and the elongated connection hole can be fitted to a connection plate of a T-shaped driven joint. With this arrangement, various types of jacks having different types of driven joints can be driven using the forward and reverse controls of a single electric tool.

U.S. Pat. No. 6,029,950

Inventor: Neng-Chen Yeh

Issued: Feb. 29, 2000

A scissor jack assembly is described having two lower arms each having an upper end portion and a lower end portion pivotally attached to a base. The two upper arms each have an upper end portion pivotally mounted to a support bracket and a lower end portion pivotally mounted to the upper end portion of one of the two respective lower arms. A drive shaft rotatingly extends through the connection of the lower end portion of one of the two respective upper arms and the upper end portion of one of the two respective lower arms. A drive device including a motor connected to a drive gear train rotates the drive shaft electrically. A drive nut is exposed for driving by a tool such as a socket for the manual rotation of the drive shaft. Thus, the jack assembly can be operated manually or electrically.

U.S. Pat. No. 6,237,953

Inventor: Dennis E. Farmer

Issued: May 29, 2001

An automatic jack and wheel change system having at least one inverted jack driven by an electric motor permanently attached to the vehicle. The system may employ a jack disposed between the front and rear wheel on each side of the vehicle, or it may be equipped with a jack at each of the four wheels. The system also includes a novel wheel and hub-axle assembly featuring a split axle whose length may be adjusted by operation of an electric motor. The hub has a plurality of arms extending from the hub in a star-shape, each arm having a finger at its free end. The system requires the user to be careful to only lift the vehicle enough to relieve the load from the wheels in order for the axle to be moved linearly. Both the motor for raising the jack and the motor for adjusting the length of the axle may be operated by remote control.

U.S. Pat. No. 6,299,138

Inventor: Chen-Ti Huang et al.

Issued: Oct. 9, 2001

A direct drive electromotive jack device for releasing a torsional force is described and comprises a jack with a driving screw rod, an electromotive motor arranged with a deceleration gearbox, a torsional force releasing means directly connected to a positioning plate, and a power supply directly switch operable by an operator. The torsional force releasing means serves to connect the electromotive motor with the jack. The torsional force releasing means comprises a positioning plate for fixing the electromotive motor; two or more than two symmetric arms of torsional force; a bearing for being passed through the electromotive motor; and a switch connected to the driving screw rod. When the rotary shaft of the electromotive motor rotates, the torsional force can be cancelled by the torsional force releasing means for preventing the jack from generating a strain or being tilt; moreover, by a switch of a power source to control the direction of the current flow, the jack can be lifted or descended.

While these automobile jacks may be suitable for the purposes for which they were designed, they would not be as suitable for the purposes of the present invention, as hereinafter described. The present invention, a motor driven scissor jacks for automobiles configured for application during inclement weather and/or at night is driven by the electric power source from the cigarette lighter socket or 12 volt socket of any automobile. A motor is configured to drive a displacement screw, clockwise, and counter clockwise in order to provide for the raising and lowering of the frame portion of the scissor jack. Upper and lower limit switches positioned in sealed housings are provided for peak to preclude damaging the motor or drive system during the raising and lowering operations of the scissor jack of the present invention.

SUMMARY OF THE PRESENT INVENTION

A primary object of the present invention is to provide a motorized scissor jack for automobiles that can be used during inclement weather.

Another object of the present invention is to provide a motorized scissor jack that is driven by the electric power source from the cigarette lighter socket or 12 volt socket of any automobile.

Yet another object of the present invention is to provide a motorized scissor jack that a motor is provided for the rotation of a displacement screw, clockwise and counter clockwise in order to provide for the raising and lowering of the frame portion of the scissor jack.

Still yet another object of the present invention is to provide a motorized scissor jack for automobiles that provides an upper limit switch positioned in a sealed housing that as the jack moves in an upward direction a driving element on one portion of the upper structure makes contact with a biased displacement element on the opposing portion of the upper structure driving a contact of the biased element into a contact of a fixed contact to complete the limiting circuit.

Another object of the present invention is to provide a motorized scissor jack for automobiles that provides a lower limit switch that as the jack moves in a downward direction the displacement screw comes in direct contact with a limit switch roller and drives a contact of a bias displacement element into a fixed contact to complete the limiting circuit.

Yet another object of the present invention is a two speed motor configured for providing a slow and a rapid lift capability.

Still, yet another object of the present invention is to provide a motor to turn a drive assembly that causes a displacement screw to turn in a rotation that either grabs or pushes the distal end of the displacement screw.

Additional objects of the present invention will appear as the description proceeds.

The present invention overcomes the shortcomings of the prior art by providing a motor driven scissor jacks for automobiles driven by the electric power source from the cigarette lighter socket or 12 volt socket of any automobile configured for use during inclement weather and/or at night. A motor is provided for the rotation of a displacement screw, clockwise and counter clockwise in order to provide for the raising and lowering of the frame portion of the scissor jack. An upper and lower limit switch are positioned in sealed housings and provide for peak and low bottom point electrical cut-offs in order to limit its raising and lowering operations of the scissor jack.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
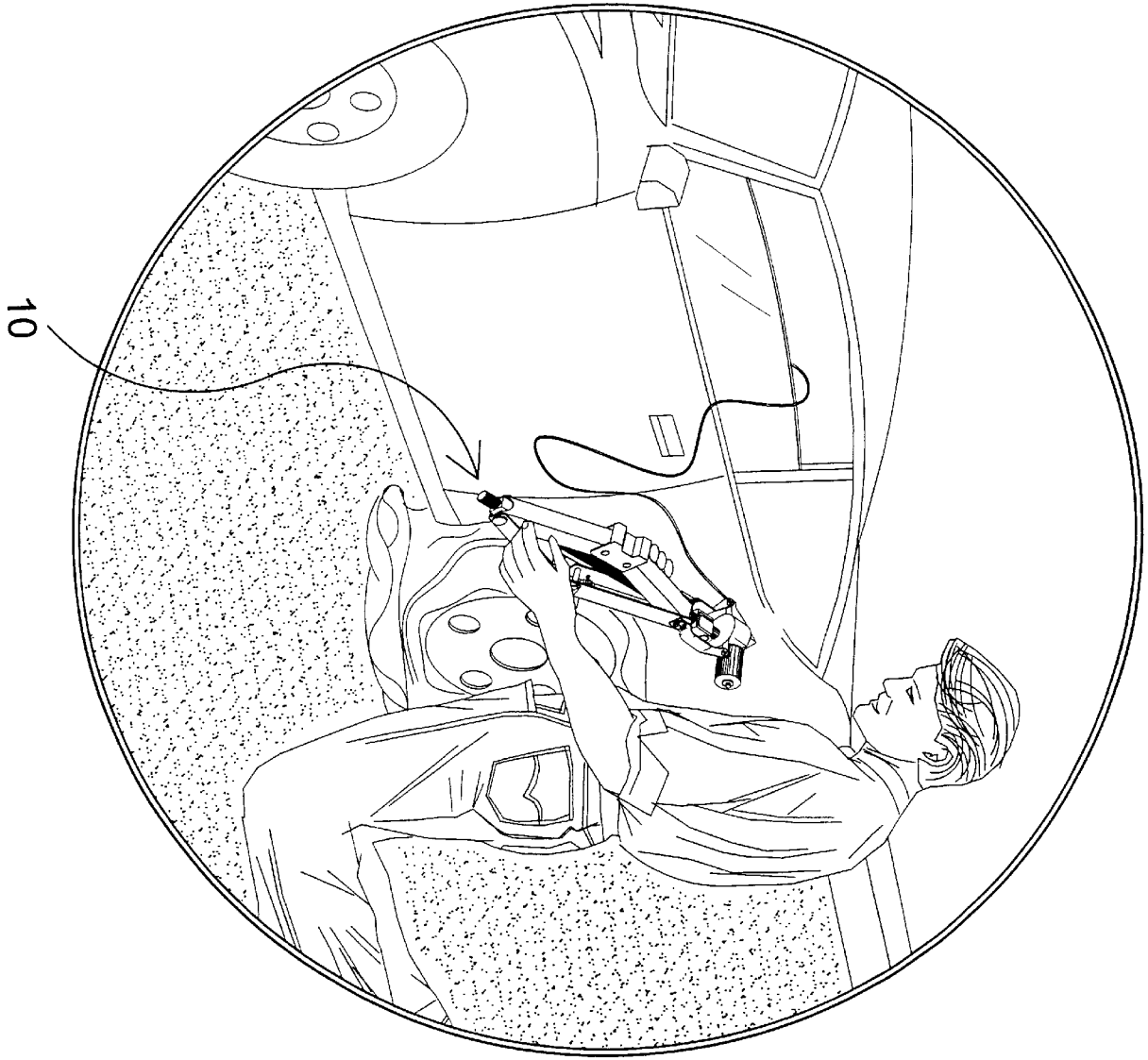
FIG. 1 is a perspective side view of a motor driven scissors jack with limit switches being positioned for use with a vehicle constructed in accordance with the present disclosure.

Turning now descriptively to the drawings, in which similar reference characters denote similar elements throughout the several views, the figures illustrate the present invention. With regard to the reference numerals used, the following numbering is used throughout the various drawing figures.

10 motor driven scissors jack with limit switches
20 lower structure
22 first member of lower structure
24 second member of lower structure
25 base plate
26 base plate adapter
27 teeth on base plate adapter
30 lower limit switch
32 fixed connector
34 biased connector
36 roller assembly positioned on bias connector
38 sealed housing for lower limit switch
40 upper structure
42 first member of upper structure
44 second member of upper structure
45 lifting block
50 upper limit switch
52 fixed connector
54 biased connector
56 receiving element
57 displacing element
58 sealed housing for upper limit switch
60 displacement screw
62 displacement screw distal end
64 displacement screw proximal end
80 drive system
82 electrical motor
84 connector adapted for a vehicle or vehicular connector
86 wire
88 light
90 drive assembly
91 bearing
92 support bracket
93 drive adapter
94 U-shaped bracket
95 pin

96 output shaft
98 gear assembly
100 switch assembly
102 on/off switch
104 light switch
105 switch assembly housing
106 switch for selecting the upward direction at a slow or fast speed
108 switch for selecting the downward direction at a slow or fast speed

DETAILED DESCRIPTION OF THE PREFERRED EMBODIMENT

The following discussion describes in detail preferred embodiments of the invention. This discussion should not be construed, however, as limiting the invention to those particular embodiments, practitioners skilled in the art will recognize numerous other embodiments as well. For definition of the complete scope of the invention, the reader is directed to appended claims.

Referring now in specific detail to the drawings in which like referenced numerals identify similar or identical elements throughout the several views, and initially to FIG. 1, a novel motor driven scissor jack with limit switches or jack 10 is shown. Jack 10 is adapted for use with vehicles and uses a battery from the vehicle as a source of power. In addition, jack 10 is configured for use during inclement or adverse weather conditions.

Figure 2:
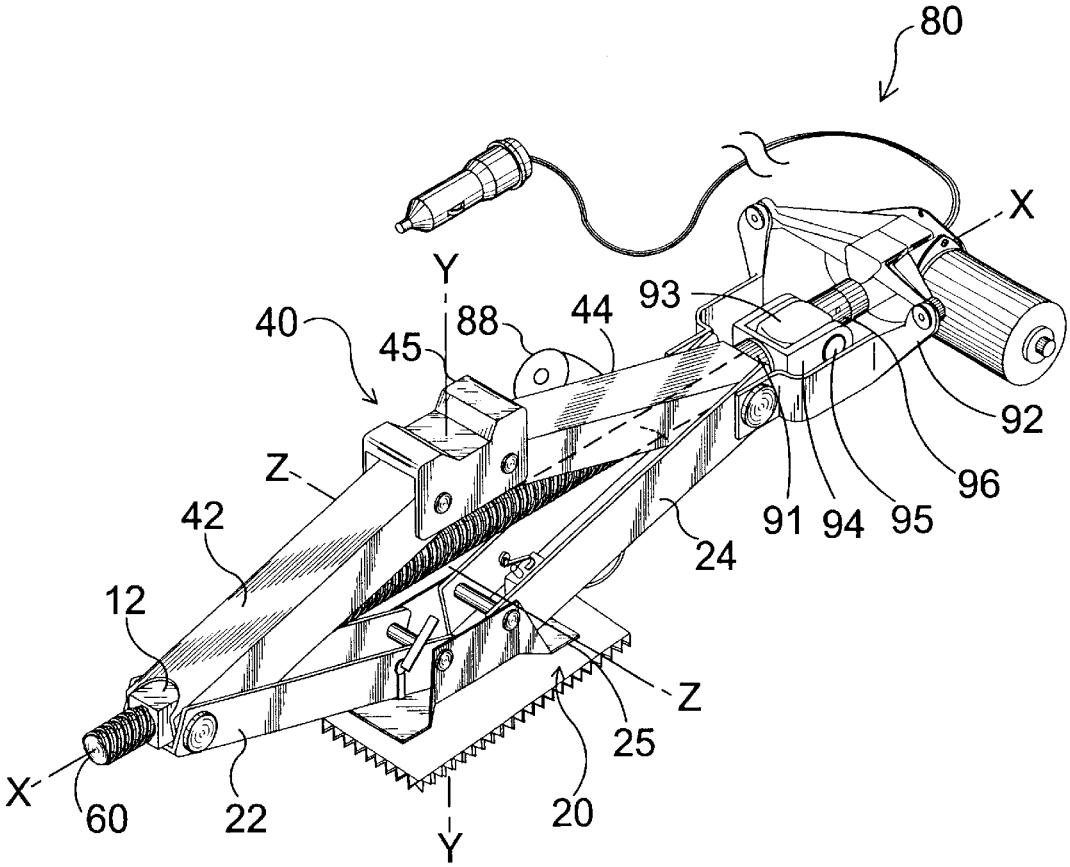
FIG. 2 is a perspective side view of the jack of FIG. 1 constructed in accordance with the present disclosure.
Figure 5:
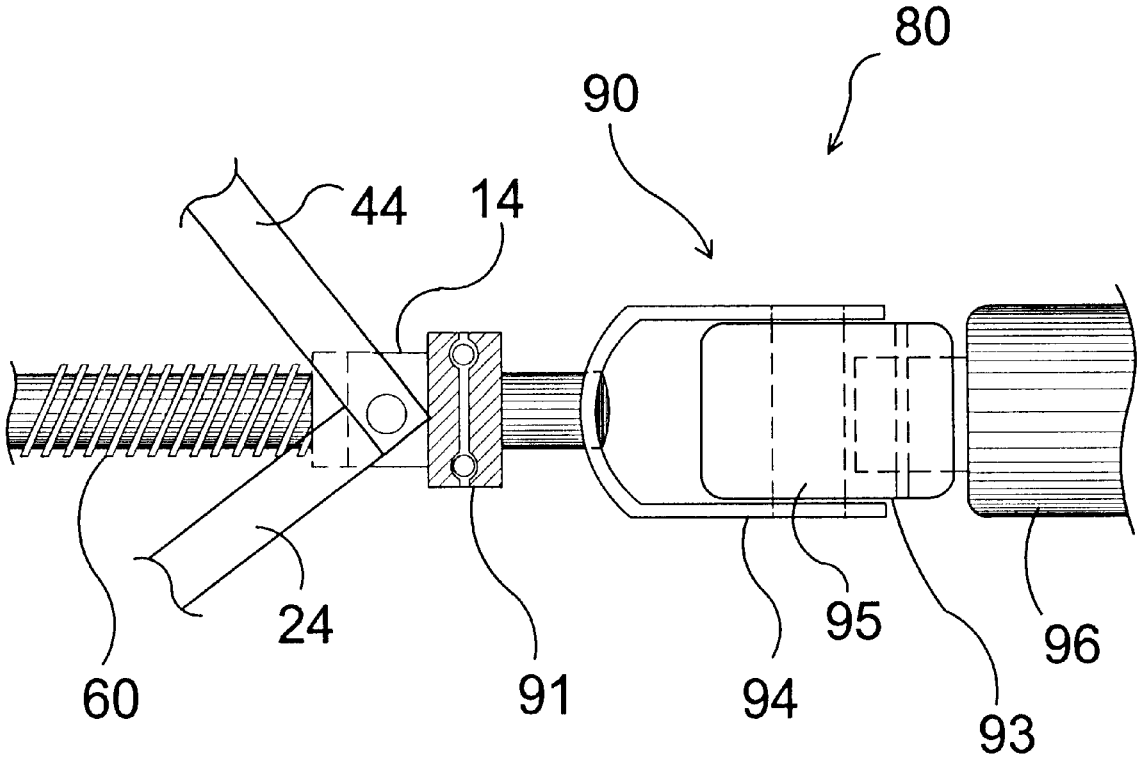
FIG. 5 is a close-up of the side view of the jack of FIG. 3 constructed in accordance with the present disclosure.

Referring now to FIGS. 2 and 5, jack 10 includes a lower structure 20, an upper structure 40, an adapter 50, a displacement screw 60, and a drive system 80. Displacement screw 60 defines a longitudinal axis-X. An axis-Y is perpendicular to axis-X and is aligned with the upward and downward movement of jack 10. An axis-Z is perpendicular to axes X and Y.

Lower structure 20 includes a base 25, a first member 22, and a second member 24. Upper structure 40 includes a first member 42, a second member 44, and a lifting plate 45.

Base 25 includes two flat legs and a pair of longitudinally aligned flanges. The legs are preferably configured for receiving a removably positioned base plate adapter 26 defining a larger supporting surface area and including teeth 27 positioned around the perimeter of plate 26 and configured for gripping into ice. The larger supporting surface area of base plate adapter 26 advantageously provides distributes the load borne by jack 10 over a greater surface area. Having a lower ground pressure can reduce the likelihood of jack 10 sinking excessively into soft soils or mud, for example.

One end of members 22 and 24 are rotatingly connected to base 25 by pins. The opposing end of member 22 is rotatingly connected with one end of member 42 and a first or distal nut block 12. Similarly, the opposing end of member 24 is rotatingly connected with one end of member 44 and a second or proximal nut block 14 (see FIG. 5). The opposing ends of members 42 and 44 are rotatingly connected to lifting plate 45 by pins. Lifting plate 45 defines a channel parallel to the axis-Y and adapted for receiving a vehicle. Members 22, 24, 42, and 44 have an elongate channel structure with the open side facing inward towards the other members.

Displacement screw 60 has a distal end 62 and a proximal end 64. Distal end 62 extends along longitudinal axis-X through first nut 12 and proximal end 64 is connected with drive system 80. Displacement screw 60 is rotatingly connected with first nut 12 and second nut 14 such that the rotation of displacement screw 60 about the longitudinal axis drives lower structure 20 and upper structure 40 between a first or minimum height position and a second maximum height position.

Drive system 80 is fixedly connected to second nut 14 and includes a motor 82 and a drive assembly 90. Proximal end 64 rotates within bearings 91 and is fixedly connected with a bifurcated or U-shaped bracket 94. U-shaped bracket 94 has a pin 95 positioned in the vicinity of the tips of its bifurcated legs through which a drive adapter 93 is positioned. Drive adapter 93 is connected by an output shaft or rod 96 with a gear assembly 98. Gear assembly 98 includes gearing means, such as bevel gears, configured to turn the drive output of motor 82 ninety degrees and connect it with drive output shaft 96. Gear assembly 98 is fixedly connected with a support bracket 92. The combination of U-shaped bracket 94, adapter 93, and pin 95 is a flexible rotating connection between displacement screw 60 and the gear assembly 98.

Motor 82 is a two speed electrical motor configured for lifting a load at a first speed and a second speed, wherein the second speed is faster than the first speed. Motor 82 is positioned parallel to axis-Z in order to minimize the length of jack 10 along longitudinal axis-X. Motor 82 is fixedly connected with support bracket 92 and gear assembly 98.

It should also be pointed out that the length of drive system 80 relative to structures 20 and 40 in the FIGURES is not considered to be proportional, but is increased for purposes of clarification of the description of the structure of the differing elements. The size of drive system 80 is intended to be minimized for safety reasons in order to minimize the amount of exposure of jack 10 and user during operational employment.

A vehicular connector 84 is adapted for coupling with a source of power or power means, such as a 12 volt automotive battery using a cigarette lighter. It is understood that the methods of coupling as well as the standard for vehicular electrical systems will evolve in time and vehicular connector 84 is intended to encompass future changes in coupling as well as voltage. A wire 86 connects connector 84 to drive assembly 80. Vehicular connector 84 can also include a standard outlet connector for residential or commercial sources of alternating current and a transformer that can be connected with vehicular connector 84. This can advantageously accommodate using an alternate source of power when in a garage or driveway situation when it is not desired to drive jack 10 off the automobile battery.

Figure 6:
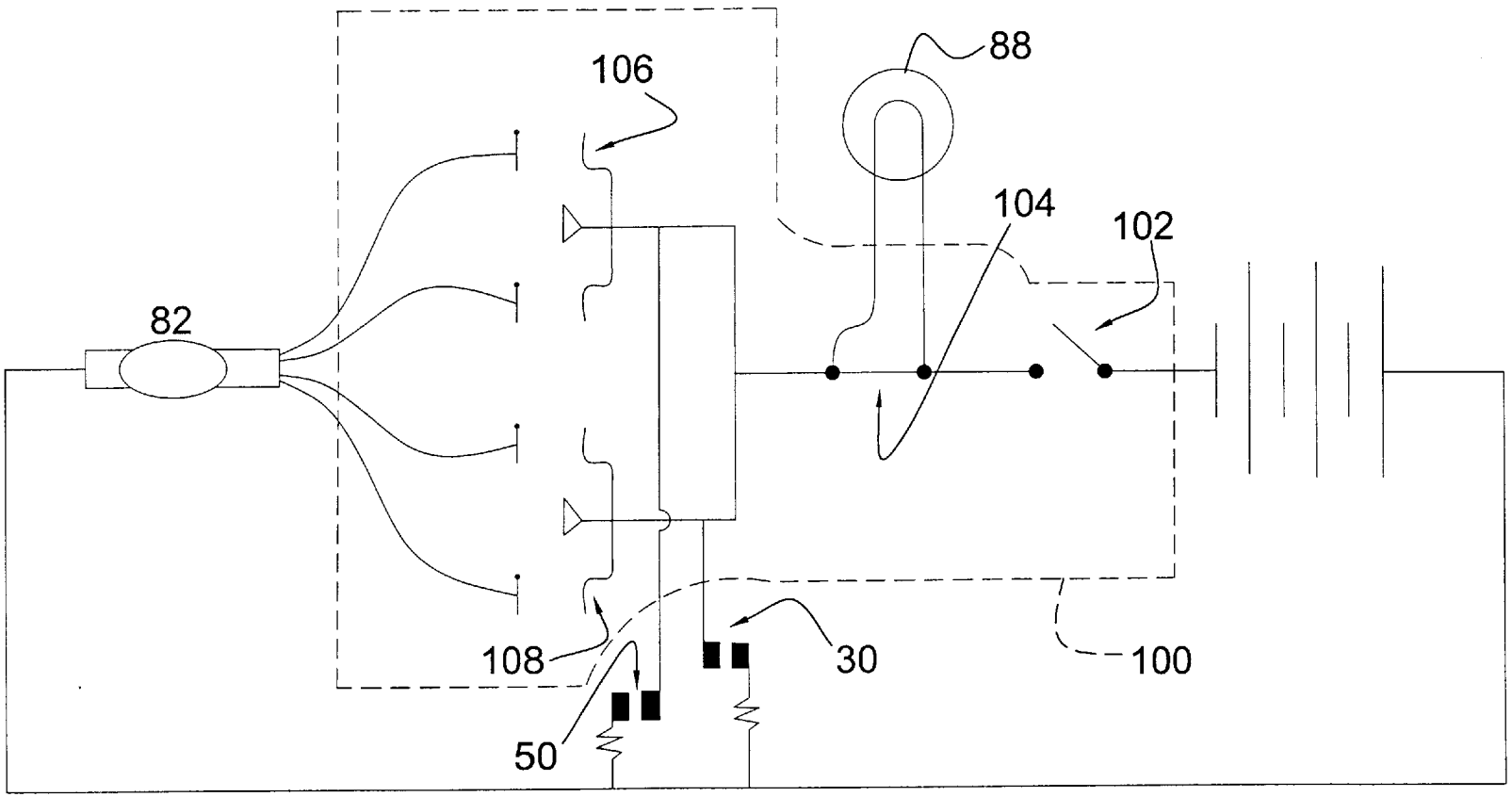
FIG. 6 is a simplified wiring diagram of the jack of FIG. 1 constructed in accordance with the present disclosure.

Jack 10 can also include a directionally adjustable light 88 having an in-line switch positioned on upper structure 40 proximal to lifting plate 45 and is connected with switch system 100 (see FIG. 6). Adjustable light 88 is configured to provide critical lighting for aligning lifting plate 45 with the chassis of the vehicle at night or during inclement weather. In one preferred embodiment, light 88 is a separately battery powered removably positionable assembly.

Figure 3:
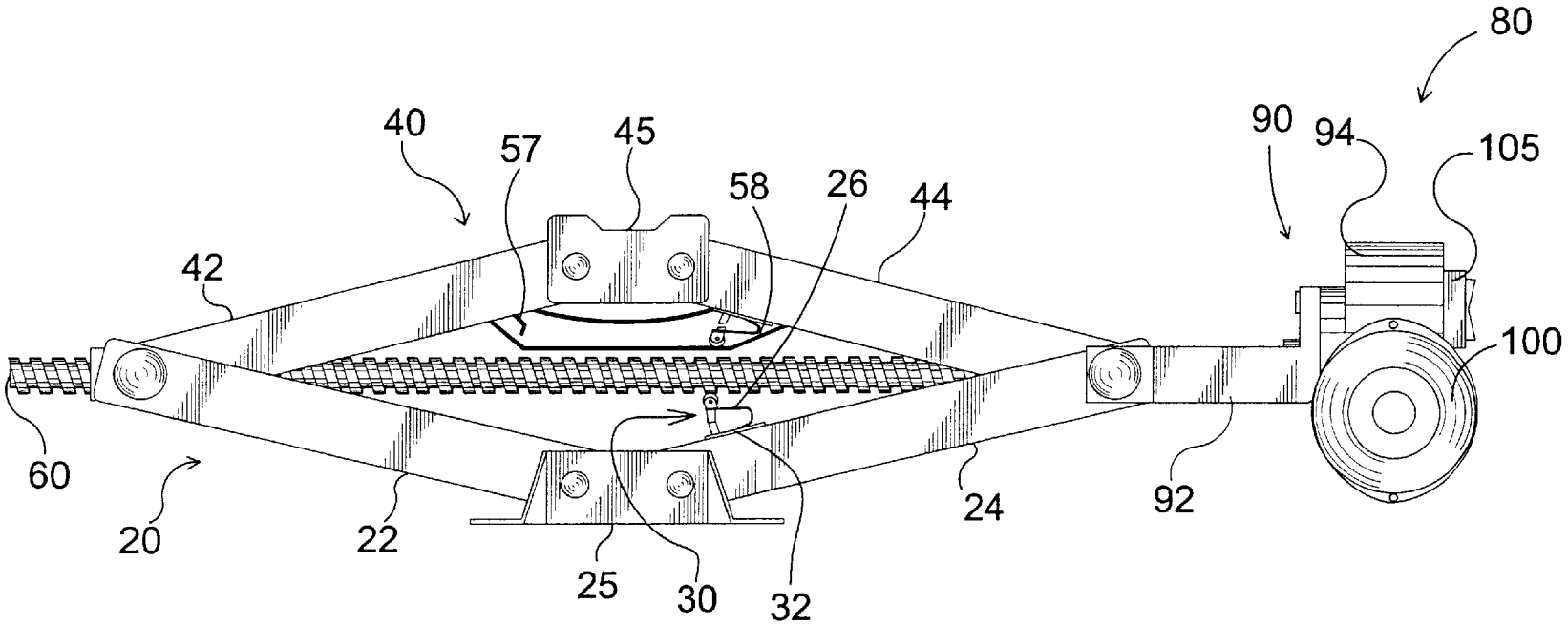
FIG. 3 is a side view of the jack of FIG. 1 in a first position constructed in accordance with the present disclosure.
Figure 7:
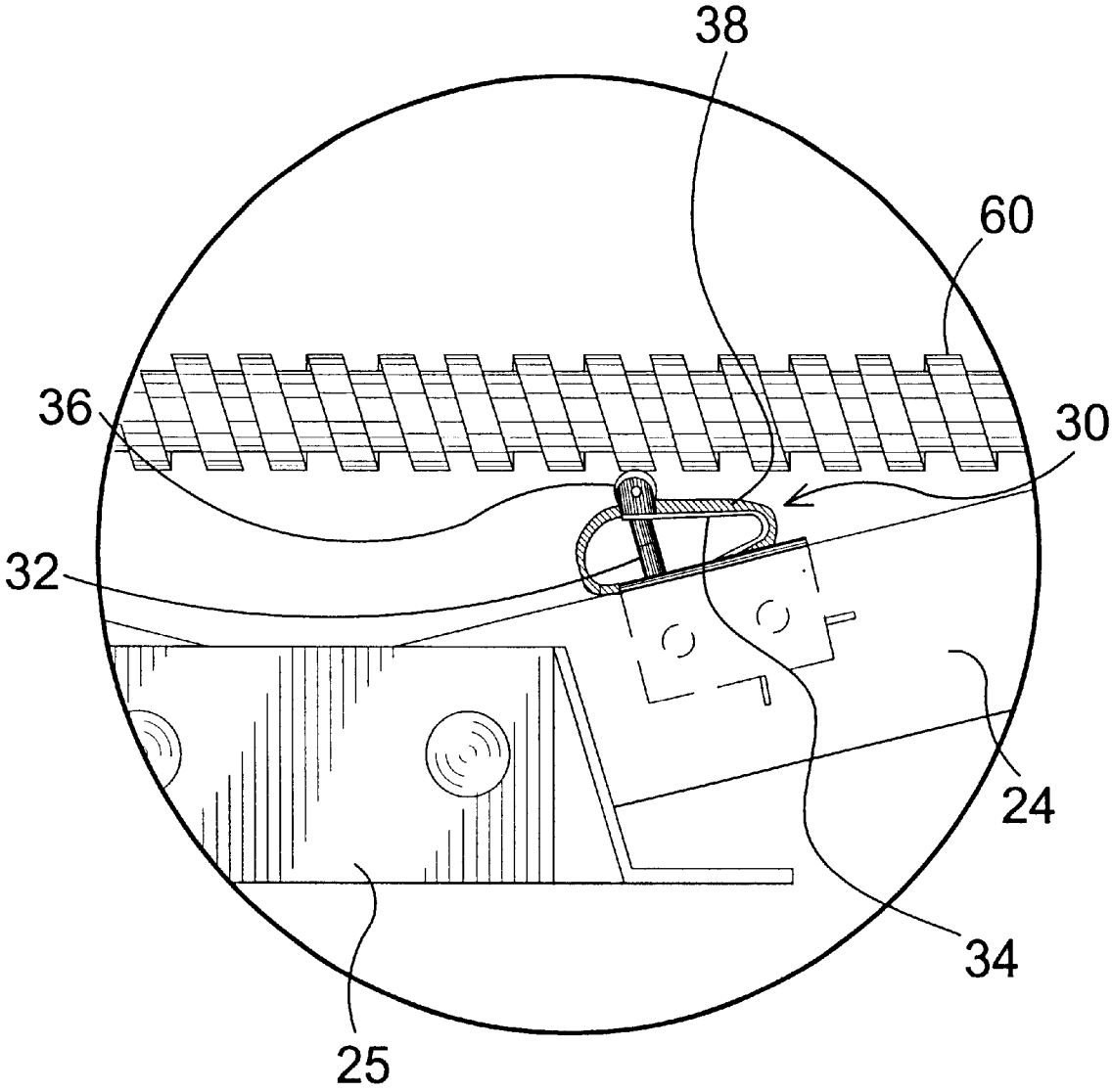
FIG. 7 is a close-up view of a lower limit switch of the jack of FIG. 1 constructed in accordance with the present disclosure.

As shown in FIGS. 3 and 7, jack is in a first position wherein the height of jack 10 in the direction of axis-Y is minimized and elongate members 22, 42, 24, and 44 are extended in proximity with longitudinal axis-X.

A lower limit switch 30 is positioned, in this one preferred embodiment, on member 24 and is aligned for contact with displacement screw 60. Limit switch 30 includes a fixedly positioned connector 32 and a biased connector 34. Biased connector 34 includes a connector positioned on an inner side of connector 34 aligned with fixed connector 32. A roller assembly 36, including a bracket and a roller, is positioned on an outer side of connector 34 facing towards displacement screw 60. The roller is rotatingly positioned on an axle and connected to the bracket. It is recognized, however, that lower limit switch 30 can be positioned on any of the members, for example, and at any point within lower structure 20, upper structure 40, or support bracket 92 that provides suitable direct contact with displacement screw 60.

Roller 36 is suitably configured and dimensioned to engage displacement screw 60. For example, roller 36 can have at least partially concave outer cylindrical surface or define a channel suitable for the positioning of at least a portion of displacement screw 60. Roller 36 is configured to roll or spin about an axis parallel with the axis-Z.

A sealed flexible housing 38 is positioned around lower limit switch 30 with the bracket and roller assembly 36 extending there from. Sealed flexible housing 38 is configured to displace longitudinally with the displacement of roller assembly 36 and to not come in direct contact with displacement screw 60 while keeping out rain, dirt, snow, as well as any other potentially intrusive material that can disrupt the performance of switch 30.

When connectors 32 and 34 of lower limit switch 30 are in direct contact, as a result of the displacement by displacement screw 60, the electrical connection for retracting or lowering jack 10 is effectively disconnected between drive system 80 and the source of power (see FIG. 6). This defines the shortest displacement of jack 10 in the direction of axis-Y and the first position.

Figure 4:
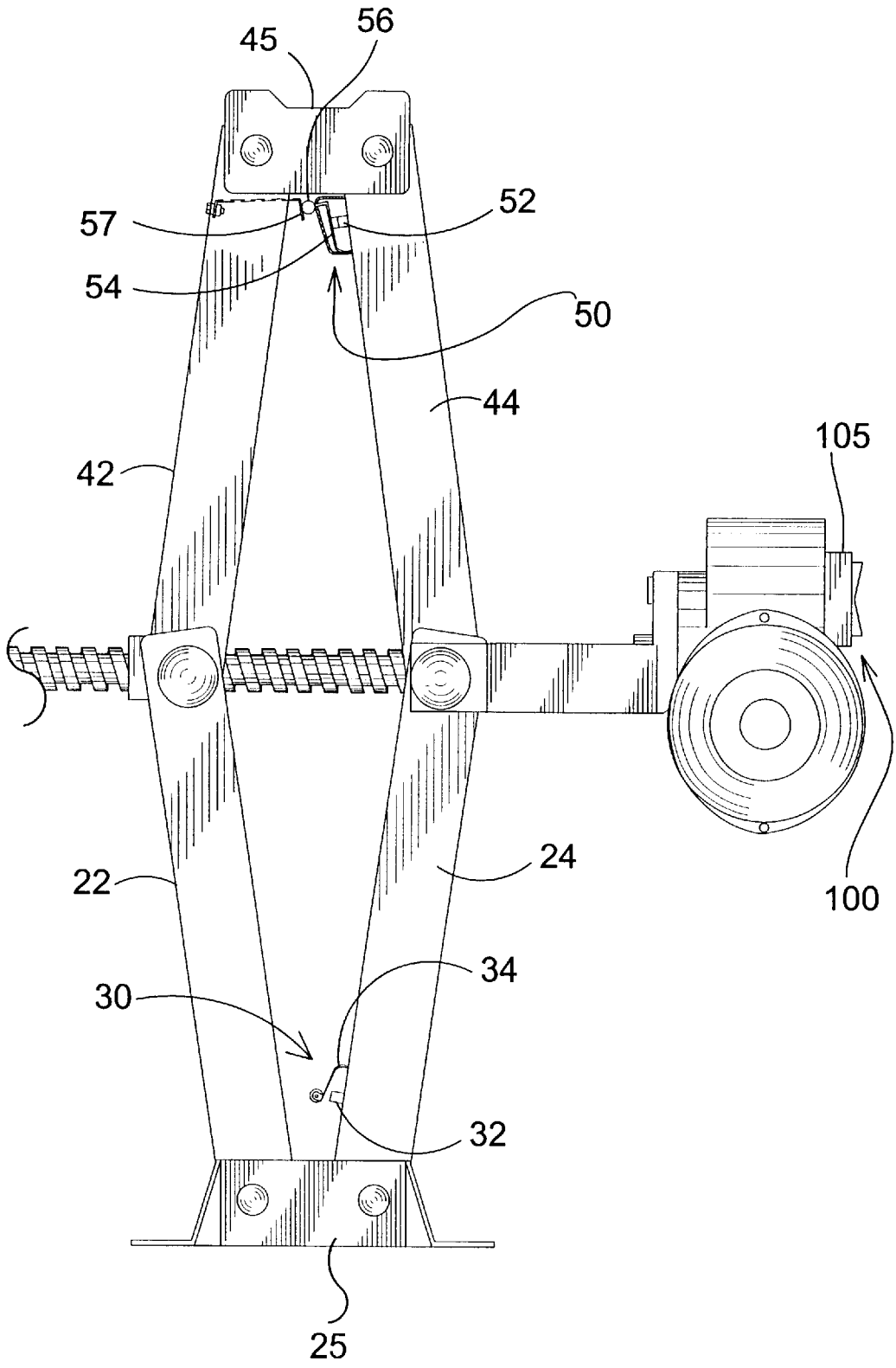
FIG. 4 is a side view of the jack of FIG. 1 in a second position constructed in accordance with the present disclosure.
Figure 8:
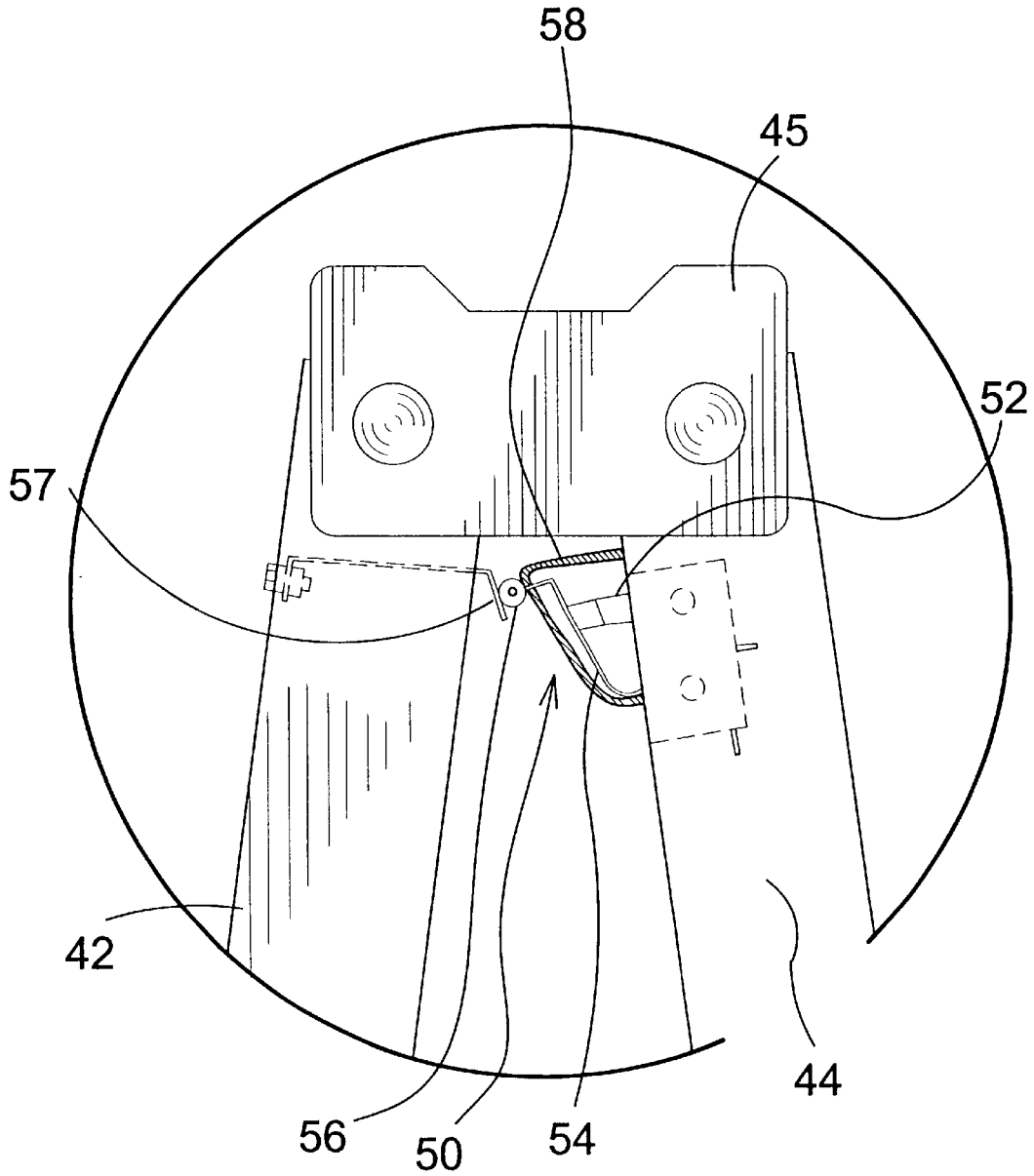
FIG. 8 is a close-up view of an upper limit switch of the jack of FIG. 1 constructed in accordance with the present disclosure.

Referring now to FIGS. 4 and 8, jack 10 in a second position wherein the height of jack 10 in the direction of axis-Y is maximized and elongate members 22, 42, 24, and 44 are extended in the general direction of axis-Y.

An upper limit switch 50 is positioned on members 42 and 44 and provides an upper limit on the extension of jack 10 in the direction of axis-Y. Upper limit switch 50 includes a fixed connector 52, a biased connector 54, a receiving element 56, and a displacing element 57. In this one preferred embodiment, fixed connector 52 and biased connector 54 are positioned on member 44 and displacing element 57 is positioned on member 42.

Biased connector 54 includes a connector element aligned with fixed connector 52 on an inner side and receiving element 56 positioned on an outer side towards displacing element 57. Biased connector 54 is biased to an open position.

A sealed flexible housing 58 is positioned around upper limit switch 50 with receiving element 56 extending there from. Sealed flexible housing 58 is configured in one preferred embodiment to displace with receiving element 56 and to not come in direct contact with displacing element 57 or member 42 while keeping out rain, dirt, snow, as well as any other potentially intrusive material that can disrupt the performance of switch 50. In another preferred embodiment, sealed flexible housing 58 also encompasses all of the components of upper limit switch 50 including displacing element 57 and receiving element 56. Upper limit switch 50 and lower limit switch 30 can also include protective and/or guiding flanges positioned to protect the moveable elements from being damaged and ensure their alignment.

Displacing element 57 is suitably positioned on member 42 such that when jack is positioned at its maximum desired displacement, receiving element 56 drives the connector element positioned on biased connector 54 into direct contact with connector 52. The direct contact of connectors 54 and 52 provides an electrical coupling which effectively disconnects the electrical connection for raising jack 10 between drive system 80 and the source of power. This defines the maximum displacement of jack 10 in the direction of axis-Z and the second position.

As shown in FIGS. 4–6, motor 82 drives jack 10 between the first and second positions through switch assembly 100. Switch assembly 100 includes a waterproof housing 105 on which is positioned an on/off switch 102 for powering jack 10, light switch 104, separate up and down directional switches 106 and 108, respectively, which selectively power a slow or fast motor speed. Switch assembly 100 is positioned on the proximal end of jack 10.

Switch assembly 100 is configured to simplify the operational use of jack 10 including switches for on/off or power to jack 10 using switch 102, light 88 using switch 104, and movement of jack 10 between first and second positions using motor 82 speeds for up/down directions of movement using switches 106 and 108, respectively. A direction and speed of movement of jack 10 is thus selected simultaneously and activated only as long as the respective switch is held in the depressed position or until a limit switch is contacted. In one preferred embodiment, an interlock prevents the simultaneous activation of switches 106 and 108.

In operation, as shown in FIGS. 2–8, the user first assess the ground surface in which the car is presently positioned to determine whether to use base plate adapter 26 to disperse the ground pressure of the load jack 10 will be lifting. Jack 10 is removed from storage, base plate adapter 26 is positioned on lower structure 20 as required, and jack 10 is positioned on the ground surface in the approximate position of use with the proximal end of jack 10 pointing out or away from the vehicle. This enables easy access to switch assembly 100 and enables lift plate 45 to be aligned with the underside of the vehicle. Jack 10 is connected with a power source such as a car cigarette lighter using wire 86 and connector 84.

Power to jack 10 is turned on using switch 102. Light 88 is powered on using switch 104 as required. Light 88 can be directionally adjusted to align lift plate 45 with a lift point on the vehicle. Jack 10 can be actuated from any position, but preferably jack 10 is initially in the first position wherein jack 10 has a reduced or minimal height in the direction of axis-Y. Jack 10 can then readily fit between the ground surface and vehicle. Jack 10 can be selectively raised to the second position or upper limit of travel position wherein limit switch 50 is engaged or the position wherein jack 10 is extended sufficiently in the direction of axis-Y to lift the vehicle the desired distance from the ground. When jack 10 is in the first position or lower limit of travel position, limit switch 30 is engaged to preclude attempting to reduce the height in the direction of the axis-Y less than the first position.

After the required maintenance is performed, the height of jack 10 is reduced in the direction of axis-Y from the second position to the first position. Jack 10 can then be turned off, removed from under the car, and then disconnected from the power source. Base plate adapter 26 is removed as required.

What is claimed as new and desired to be protected by Letters Patent is set forth in the appended claims:

1. A motor driven scissors jack assembly comprising:

a scissors jack including a lower structure connected to an upper structure, a displacement screw connected to the upper structure, lower structure, and a drive system, the drive system including a motor for extending and retracting the jack, the jack being adapted for use with a vehicular electrical system;

a lower limit switch positioned on the lower structure, the lower limit switch including a roller assembly configured for being in direct contact with the displacement screw as the jack approaches a lower limit of travel, the limit switch being configured such that the position of the displacement screw at the lower limit of travel engages the roller assembly and connects the lower limit switch, the lower limit switch being configured to limit the retracting of the jack; and an upper limit switch positioned on the members of the upper structure, the position of the members of the upper structure at an upper limit of travel position being configured to connect the upper limit switch, the connecting of the upper limit switch being configured to limit the extending of the jack.

2. The jack of claim 1, wherein the motor has two speeds.

3. The jack of claim 1, wherein the lower limit switch further includes a housing, a biased connector, and a fixed connector, the housing being configured for sealing the biased connector and fixed connector of the lower limit switch.

4. The jack of claim 3, wherein the roller assembly of the lower limit switch is positioned outside the housing and is aligned for rolling engagement with the displacement screw.

5. The jack of claim 1, wherein the upper limit switch includes a housing, the housing being configured for sealing at least a portion of the upper limit switch.

6. The jack of claim 5, wherein the upper limit switch includes a displacement element positioned on one member of the upper structure and a receiving element positioned on the opposing member of the upper structure, the direct contact of the displacing element with the receiving element at the upper limit position connecting the upper limit switch.

7. The jack of claim 5, wherein the displacing element and receiving element are positioned outside the housing and aligned for direct contact.

8. A motor driven scissors jack assembly comprising:

a scissors jack including a lower structure connected to an upper structure, a displacement screw connected to the upper structure, lower structure, and a drive system, the drive system including a motor, the motor drive jack being adapted for use with a vehicular electrical system;

a lower limit switch positioned in a sealed housing on the lower structure, the lower limit switch including a roller assembly positioned outside of the housing and configured for being in direct contact with the displacement screw as the jack approaches a lower limit of travel, the limit switch being configured such that the position of the displacement screw at the lower limit of travel engages the roller assembly and connects the lower limit switch, the lower limit switch being configured to limit the retracting of the jack; and an upper limit switch positioned in a sealed housing, the position of the members of the upper structure at an upper limit of travel position being configured to connect the upper limit switch, the connecting of the upper limit switch being configured to limit the extending of the jack.

9. The jack of claim 8, wherein the motor has two speeds for extending the jack and two speeds for retracting the jack.

10. The jack of claim 8, wherein the upper limit switch includes a displacement element positioned on one member of the upper structure and a receiving element positioned on the opposing member of the upper structure.

11. The jack of claim 8, wherein the displacement element and the receiving element are positioned outside the sealed housing of the upper limit switch.

12. The jack of claim 8, wherein the displacing element and the receiving element are positioned inside the sealed housing of the upper limit switch.

13. The jack of claim 8, wherein the displacing element is aligned and configured for direct contact with the receiving element.

14. The jack of claim 8, wherein the jack includes a vehicular connector configured for connecting the jack with a power source.

15. The jack of claim 8, wherein the lower structure includes a base plate, the base plate being configured for connecting with an adapter plate.

16. The jack of claim 8, wherein the jack includes a light.

17. A motor driven scissors jack assembly comprising:

a scissors jack including a lower structure connected to an upper structure, a displacement screw connected to the upper structure, lower structure, and a drive system, the drive system including a motor having two speeds for extending the jack and two speeds for retracting the jack, the motor drive jack being adapted for use with an external source of power;

a lower limit switch positioned in a sealed housing on the lower structure, the lower limit switch including a roller assembly positioned outside of the housing and configured for being in direct contact with the displacement screw as the jack approaches a lower limit of travel, the limit switch being configured such that the position of the displacement screw at the lower limit of travel engages the roller assembly and connects the lower limit switch, the lower limit switch being configured to limit the retracting of the jack; and an upper limit switch positioned in a sealed housing, the upper limit switch including a displacement element positioned on one member of the upper structure and a receiving element positioned outside the sealed housing of the upper limit switch on the opposing member of the upper structure, the displacing element being aligned and configured for direct contact with the receiving element, the position of the members of the upper structure at an upper limit of travel position being configured to connect the upper limit switch, the connecting of the upper limit switch being configured to limit the extending of the jack.

18. The jack of claim 17, wherein the source of power is a battery of a vehicular electrical system.

19. The jack of claim 17, wherein the lower structure includes a base plate, the base plate being configured for connecting with an adapter plate.

20. The jack of claim 17, wherein the jack includes a light.

* * * * *